US009896962B2

(12) United States Patent
Wojick et al.

(10) Patent No.: US 9,896,962 B2
(45) Date of Patent: Feb. 20, 2018

(54) TRIP MANIFOLD ASSEMBLY FOR TURBINE SYSTEMS

(71) Applicant: General Electric Company, Schenectady, NY (US)

(72) Inventors: Troy Gilchrist Wojick, Broomfield, CO (US); Ricardo Stack, Schenectady, NY (US); Joe Lisowski, Covington, PA (US); Chris Bradford, Bellingham, MA (US)

(73) Assignee: General Electric Company, Schenectady, NY (US)

( * ) Notice: Subject to any disclaimer, the term of this patent is extended or adjusted under 35 U.S.C. 154(b) by 836 days.

(21) Appl. No.: 14/194,261

(22) Filed: Feb. 28, 2014

(65) Prior Publication Data

US 2015/0247421 A1 Sep. 3, 2015

(51) Int. Cl.

| | |
|---|---|
| ***F01D 21/16*** | (2006.01) |
| ***F01D 21/18*** | (2006.01) |
| ***F01D 21/20*** | (2006.01) |

(52) U.S. Cl.

CPC ..... *F01D 21/18* (2013.01); *Y10T 137/87917* (2015.04)

(58) Field of Classification Search

CPC .. F01D 21/16; F01D 21/18; Y10T 137/87917; Y10T 137/87925; Y10T 137/87933; Y10T 137/87941; Y10T 137/87949; Y10T 137/87957; Y10T 137/87965; Y10T 137/879973

See application file for complete search history.

(56) References Cited

U.S. PATENT DOCUMENTS

| | | | | |
|---|---|---|---|---|
| 3,928,975 | A | 12/1975 | Braytenbah | |
| 3,928,976 | A | 12/1975 | Braytenbah et al. | |
| 3,928,977 | A | 12/1975 | Braytenbah et al. | |
| 3,931,714 | A | 1/1976 | Jaegtnes et al. | |
| 5,143,119 | A * | 9/1992 | Plangger | F01D 17/26 137/557 |
| 5,217,199 | A * | 6/1993 | Frey | F01D 21/20 251/29 |

(Continued)

FOREIGN PATENT DOCUMENTS

| | | | | |
|---|---|---|---|---|
| DE | 102011082599 | A1 * | 3/2013 | F15B 11/006 |
| DE | 102015210254 | A1 * | 12/2015 | F01D 17/26 |

(Continued)

*Primary Examiner* — Jason Shanske
*Assistant Examiner* — Jessica Kebea
(74) *Attorney, Agent, or Firm* — Fletcher Yoder, P.C.

(57) ABSTRACT

A system includes a trip manifold assembly (TMA). The TMA includes a plurality of block valves configured to receive a flow of fluid from a hydraulic power unit (HPU), and a plurality of solenoid valves configured to admit the flow of fluid to actuate the plurality of block valves, a plurality of dump valves, and a plurality of relay valves of the TMA. The plurality of solenoid valves is configured to admit a respective portion of the flow of fluid. The plurality of dump valves is configured to depressurize a trip header of the TMA as an output to operate a plurality of stop valves coupled to a turbine system. The TMA is configured to regulate the flow of fluid to control the operation of the plurality of stop valves as a mechanism to interrupt an operation of the turbine system.

15 Claims, 4 Drawing Sheets

BLOCK AND BLEED (BB)

(56) References Cited

U.S. PATENT DOCUMENTS 5,269,141 A * 12/1993 Burch ..... F01D 17/26 137/102
5,280,807 A * 1/1994 Frey ..... F01D 21/18 137/556
5,561,976 A * 10/1996 Chu ..... F02C 7/232 60/39.463
6,116,258 A * 9/2000 Shapiro ..... F01D 17/145 137/1
6,186,167 B1 2/2001 Grumstrup et al.
7,137,407 B2 11/2006 Sweeney et al.
7,409,965 B2 8/2008 Blaser et al.
7,444,920 B2 * 11/2008 Herrmann ..... F15B 11/042 91/433
7,556,238 B2 7/2009 Seberger
7,874,241 B2 * 1/2011 Natili, Jr. ..... F01D 21/18 91/448
8,151,813 B2 * 4/2012 Jacoby ..... G05B 9/03 137/1
8,662,106 B2 * 3/2014 Reumschussel ..... F01D 17/26 137/596.15
8,794,268 B2 * 8/2014 Cole ..... F01D 17/145 137/557
9,328,842 B2 * 5/2016 Tauber ..... F15B 20/008
2006/0185745 A1 8/2006 Sweeney et al.
2008/0087339 A1 4/2008 Blaser et al.
2013/0327408 A1 * 12/2013 Jacobs ..... F01D 21/16 137/2

FOREIGN PATENT DOCUMENTS

EP 1920298 A1 5/2008
EP 2074488 A1 1/2009
EP 2074488 B1 1/2009
WO 2008048290 A1 4/2008

* cited by examiner

TRIP MANIFOLD ASSEMBLY FOR TURBINE SYSTEMS

BACKGROUND

The subject matter disclosed herein relates to turbine systems, and more specifically, to trip manifold assemblies for the turbine systems.

Certain turbine systems may include overspeed protection systems (EOPS) that may be used to temporarily shut down the turbine system under certain operation conditions. The turbine and EOPS systems may use hydraulic systems to control and actuate the shutdown of the turbine systems. However, some EOPS systems may be subject to slow response times, contaminations that may become present within the hydraulic systems, and may be operational only within limited pressure ranges. It may be useful to provide systems to improve hydraulic EOPS systems.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a trip manifold assembly (TMA). The TMA includes a plurality of block valves configured to receive a flow of fluid from a hydraulic power unit (HPU), and a plurality of solenoid valves configured to admit the flow of fluid to actuate the plurality of block valves, a plurality of dump valves, and a plurality of relay valves of the TMA. The plurality of solenoid valves is configured to admit a respective portion of the flow of fluid. The plurality of dump valves is configured to depressurize a trip header of the TMA as an output to operate a plurality of stop valves coupled to a turbine system. The TMA is configured to regulate the flow of fluid to control the operation of the plurality of stop valves as a mechanism to interrupt the operation of the turbine system.

In accordance with a second embodiment, a system includes a plurality of stop valves coupled to a turbine system, a hydraulic power unit (HPU) configured to deliver a flow of fluid to the plurality of stop valves to regulate the turbine system, and a trip manifold assembly (TMA) communicatively coupled to the plurality of stop valves and the HPU. The TMA includes a plurality of block valves configured to receive the flow of fluid from the HPU, and a plurality of solenoid valves configured to admit the flow of fluid to actuate a plurality of block valves, a plurality of dump valves, and a plurality of relay valves of the TMA. The plurality of relay valves is respectively coupled to each of the plurality of solenoid valves. The plurality of dump valves is respectively coupled to each of the plurality of solenoid valves and each of the plurality of relay valves. The plurality of dump valves is configured to depressurize a trip header of the TMA as an output to operate the plurality of stop valves to interrupt an operation of the turbine system.

In accordance with a third embodiment, a system includes an emergency overspeed protection system (EOPS). The EOPS includes a trip manifold assembly (TMA). The TMA includes a first flow path, a second flow path, and a third flow path. The first flow path, the second flow path, and the third flow path are parallel to each other. The TMA is configured to operate according to a triple modular redundant (TMR) functionality to regulate a flow of fluid by way of a subset of the first flow path, the second flow path, and the third flow path to control an operation of a turbine system or a generator system. The TMA is configured to interrupt the operation of the turbine system or the generator system based on a characteristic of the flow of fluid.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Present embodiments relate to an advanced electro-hydraulic trip manifold assembly (TMA) suitable for use with turbine emergency shutdown systems and/or emergency overspeed protection system (EOPS). Specifically, the TMA may include an interface between an electronic control system and hydraulically powered final control elements (e.g., stop valves) of the turbine control and emergency shutdown system. In certain embodiments, the TMA may be contamination resistant and fault tolerant, exhibit a triple modular redundant (TMR) design, and may also be configurable to a block-and-bleed (BB) configuration, a remote pilot (RP) configuration, and a local pilot (LP) to allow application to substantially all commercially available (or those that may become available in the future) turbine and EOPS system configurations and/or operating conditions. The TMA may also include parallel arrangements of solenoid valves, block valves, instrumented dump valves, relay valves, orifices 36, filter, and check valves, packaged as a single integrated hydraulic circuit with defined configurable flow passages. In this way, the TMA may provide for large flow capacity, extremely fast response times (e.g., the time between which an adverse condition is detected and the TMA operates), and increased tolerance to contamination that may become present in hydraulic flow control systems, and reduced system complexity, and so forth. Moreover, due to TMR characteristics of the TMA, the TMA may also provide for full on-line (e.g., during operation) testing of the TMA, as well as other on-line maintenance capabilities.

Figure 1:
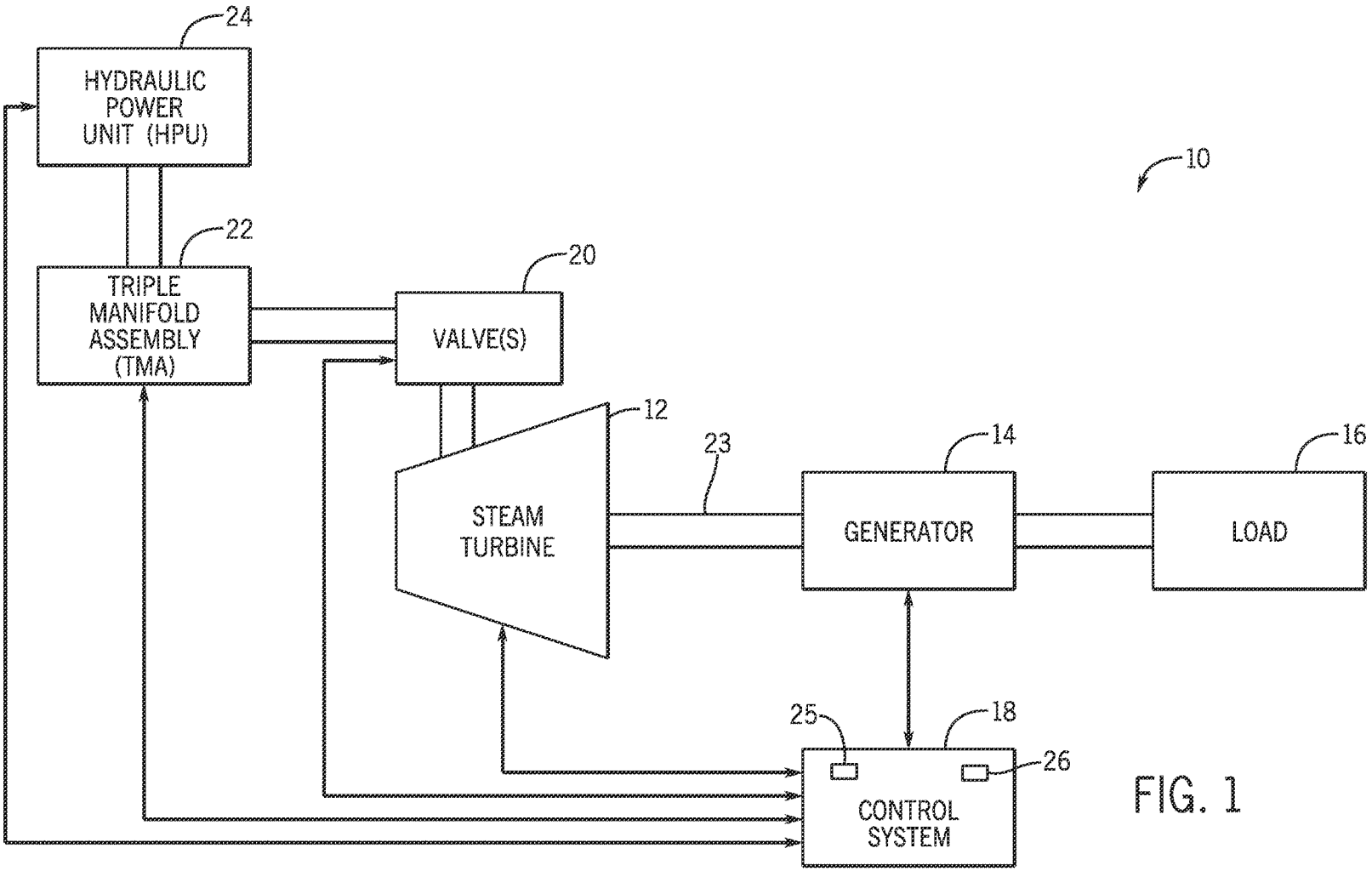
FIG. 1 is a block diagram of an embodiment of a turbine-generator system including a trip manifold assembly (TMA) in accordance with present embodiments.

With the foregoing in mind, it may be useful to describe a turbine-generator system, such as an example turbine-generator system 10 illustrated in FIG. 1. As depicted, the system 10 may include a steam turbine 12 (or gas turbine 12) and a generator 14 coupled to a load 16, all of which may be communicatively coupled to a control system 18. The turbine 12 may be further coupled to one or more valves 20 and one or more trip manifold assemblies (TMA) 22, which may control the fluid intake to the turbine 12. The turbine 12 may use the fluid (e.g., steam, fuel, and so forth) to deliver an output (e.g., mechanical power output) via a shaft 23 to the generator 14. In certain embodiments, the valves 20 may include a number of parallel valves (e.g., 2, 3, 4, or more valves), which may regulate the intake of the turbine 12 according to any of a number of fluid admission techniques (e.g., full arc admission and/or partial arc admission). For example, the one or more valves 20 may be actuated and/or positioned (e.g., controlled by the control system 18) concurrently, allowing equal intake to the turbine 12. As will be further appreciated, in certain embodiments, the valves 20 may include a number of hydraulic powered stop valves and/or safety valves that may be controlled by the TMA 22 during, for example, an emergency trip (e.g., temporary interruption) of the turbine 12. For example, as further illustrated, a hydraulic power unit (HPU) 24 may be provided to convert a primary source (e.g., mechanical power and/or electrical power) into a hydraulic fluid flow that may be used to operate the TMA 22, and by extension, the valves 20 to trip and/or temporarily shut down the turbine 12.

In certain embodiments, the TMA 22 may include an interface between the HPU 24, the valves 20 (e.g., stop valves and/or safety valves), and the control system 18 used, for example, to control the turbine 12 to complete an emergency system trip and/or shutdown. For example, the TMA 22 may include any contamination resistant electro-hydraulic trip manifold assembly suitable for use with turbine and EOPS systems and other similar industrial systems. For example, as will be further appreciated, in certain embodiments, the TMA 22 may include parallel arrangements of solenoid valves, hydraulic block valves, instrumented dump valves, relay valves orifices, filters, check valves, or other similar valves that may be assembled as a single, integrated hydraulic circuit. The TMA 22 may also include defined and/or configurable flow passages for improved flow and pressure control during, for example, an emergency trip or shutdown of the turbine 12. Furthermore, in some embodiments, the TMA 22 may be configured in three discrete hydraulic configurations. For example, the trip manifold assembly 22 may include a block-and-bleed (BB) configuration, a remote pilot (RP) configuration, or a local pilot (LP) configuration to allow application to substantially all commercially available (or those that may become available in the future) steam turbine 12 (or gas turbine 12) and EOPS system configurations.

As previously noted, the system 10 may also include the control system 18. The control system 18 may be suitable for generating and implementing various control algorithms and techniques to control the valves 20, the TMA 22, and the HPU 24, and by extension, the fluid intake and/or other operational parameters of the turbine 12. The control system 18 may also provide an operator interface through which an engineer or technician may monitor the components of the turbine-generator system 10 such as, components (e.g., sensors) of the turbine 12 and the generator 14. Accordingly, the control system 18 may include a processor 25 that may be used in processing readable and executable computer instructions, and a memory 26 that may be used to store the readable and executable computer instructions and other data. These instructions may be encoded in programs stored in tangible non-transitory computer-readable medium such as the memory 26 and/or other storage of the control system 18. In certain embodiments, the control system 18 may also host various industrial control software, such as a human-machine interface (HMI) software, a manufacturing execution system (MES), a distributed control system (DCS), and/or a supervisor control and data acquisition (SCADA) system. The control system 18 may further support one or more industrial communications (e.g., wired or wireless) protocols. For example, the control system 18 may support GE ControlST™ available from General Electric Co., of Schenectady, N.Y.

Figure 2:
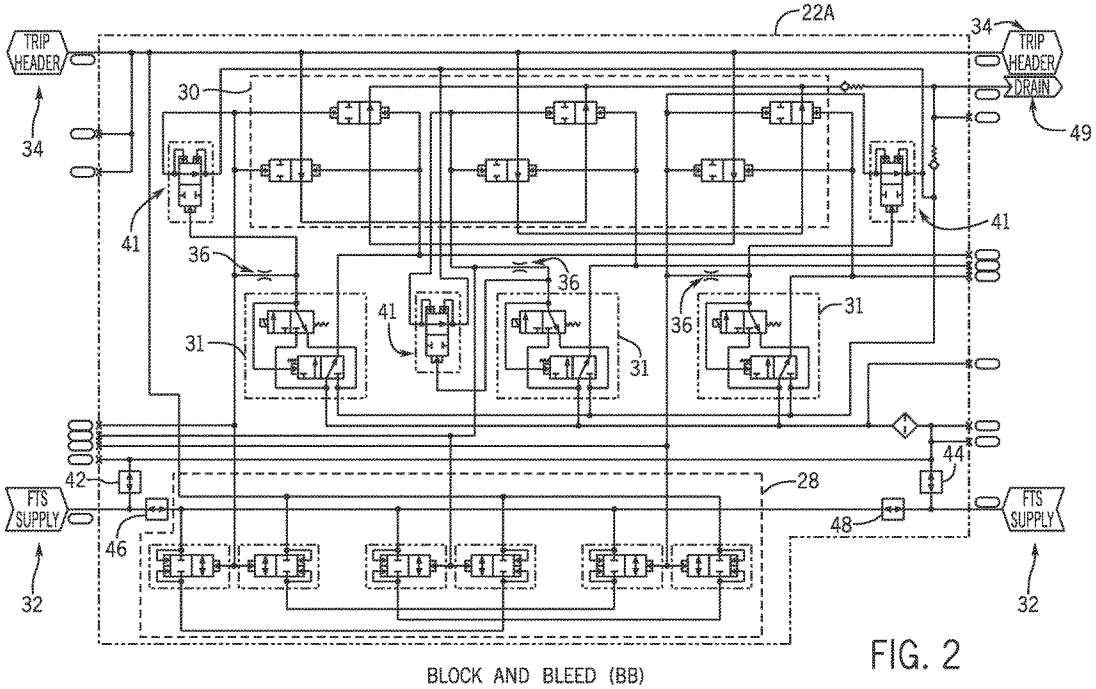
FIG. 2 is a block diagram of an embodiment of the TMA within the system of FIG. 1, including a block and bleed (BB) configuration, in accordance with present embodiments.

Turning now to FIG. 2, which illustrates the block-and-bleed (BB) configuration 22A of the TMA 22. As depicted, in the BB configuration 22A, the TMA 22 may generally include a system of internal block valves 28, a system of dump valves 30, a system of internal solenoid valves 31, and relay valves 41, fluid supplies (FTS) 32, trip header 34, and open plugs 42, 44, 46, and 48. During operation, the system of internal block valves 28, the system of internal dump valves 30, the solenoid valves 31, and the relay valves 41 may be used to depressurize the trip header 34 to close the valves 20 (e.g., stop valves 20) for routine and/or emergency shutdowns of the turbine 12. Specifically, in the BB configuration 22A, the system of internal block valves 28 may include three parallel flow paths (e.g., of equal respective portions of the total flow). The parallel block valves 28 may receive fluid from the FTS supply 32 to be later admitted to the trip header 34. The TMA 22 in the BB configuration 22A may also include three parallel flow paths to a drain 49. The parallel flow paths to the drain 49 may be each controlled by the system of dump valves 30. As depicted, the system of block valves 28 may be hydraulically operated valves for each of the three flow paths extending therefrom. Similarly, the solenoid valves 31 may, in some embodiments, include three poppet-solenoid valves 31 used to control the hydraulic pilot pressure to open or close the relay valves 41, the system of block valves 28, and/or system of dump valves 30 (e.g., only one of three valves, only two of three valves, all three valves, and so forth) as part of the TMR functionality of the TMA 22. In this way, if one of the solenoid valves 31, relay valves 41, system of block valves 28, and/or system of dump valves 30 are decommissioned and/or fail, the TMA may continue to operate (e.g., continue to provide tripping and/or emergency shutdown functionality) with little or no disturbance to, for example, the turbine 12. In such an embodiment, particularly under normal operating conditions, the solenoid valves 31, relay valves 41, and/or system of dump valves 30 may operate according to a "voting" (e.g., two-out-of-three) logic (e.g., controlled by way of the control system 18) to separate two of three hydraulic fluid flow paths and maintain at least one fluid depressurization path.

In certain embodiments, when the solenoid valves 31 are energized, the FTS supply 32 may be opened, the system of block valves 28 may be opened, and the system of dump valves 30 may close to admit fluid and pressurize the trip headers 34. In this way, the BB configuration 22A of the TMA 22 may ensure that the failure of a single solenoid valve 31 may not affect the entire TMA 22 operation and/or functionality. On the other hand, when the solenoid valves 31 are de-energized, the FTS supply 32 to the trip header 34 may be blocked, and the trip headers 34 may be then depressurized through the system of dump valves 30. As previously noted, in this manner, the failure of a single solenoid valve 31 may not affect the complete tripping function of the TMA 22. That is, the TMA 22 may continuously provide tripping and/or emergency shutdown functionality even when one of the solenoid valves 31 may be decommissioned or otherwise rendered temporarily inoperable.

In certain embodiments, the TMA 22 (e.g., in each of the block-and-bleed (BB), remote pilot (RP), and local pilot (LP) configurations) may be useful in operating at hydraulic pressure ranges ranging from very low hydraulic pressures (e.g., less than approximately 200 pounds per square inch (psig), less than approximately 100 psig, less than approximately 90 psig, less than approximately 85 psig, less than approximately 80 psig, less than approximately 75 psig, less than approximately 70 psig, less than approximately 65 psig, less than approximately 60 psig, or lower pressures) to very high pressures (e.g., greater than approximately 800 psig, greater than approximately 1000 psig, greater than approximately 2000 psig, greater than approximately 2100 psig, greater than approximately 2200 psig, greater than approximately 2300 psig, greater than approximately 2400 psig, greater than approximately 2700 psig, or higher pressures). Specifically, by providing the BB, RP, and LP configurations, each corresponding to various configurations of turbines 12, the TMA 22 may provide for large flow capacity, extremely fast response times (e.g., as compared to non-configurable and/or single-configuration manifolds), and increased tolerance to contamination that may become present in turbine 12 hydraulic flow control systems.

For example, the arrangement (e.g., pressure-assisted arrangement) of the system of dump valves 30 and relay valves 41 may provide a significant improvement in response time as compared to non-configurable and/or single-configuration manifolds. Similarly, as previously noted, the TMA 22 may provide for high-capacity flow rates due to the increase in effective flow area provided by the TMA 22 without significantly increasing the physical size of the TMA 22. Yet still, as also noted above, the TMA 22 may provide for an increased operating pressure range (e.g., an operating pressure range of less than approximately 75 psig to greater than approximately 2700 psig) by possibly changing or tuning the restriction orifices 50 using similar components and/or seals at all pressures (e.g., from very low pressures (75 psig) to very high pressures (2700 psig)) and for all typical turbine 12 hydraulic control fluids. It should be appreciated that, in some embodiments, the LP configuration 22B may include the restriction orifice 50, and may thus allow for the aforementioned increased operating pressure range by possibly changing or tuning the restriction orifices 50. Similarly, the RP configuration 22C may allow for the very low pressure applications due to having the separate remote pilot supply 60 coming into the TMA 22.

Furthermore, due to the triple modular redundant (TMR) functionality of the TMA 22, the TMA 22 may also provide for full on-line (e.g., during operation of the turbine 12) testing capabilities, as well as other on-line maintenance capabilities. This may allow the turbine 12 to be quickly tripped or temporarily shut down. For example, in certain embodiments, the TMA 22 may include closed valve limit switches that may alarm during, for example, conditions that may lead to a turbine operation failure. Specifically, when the solenoid valves 31 are de-energized the FTS supply 32 to the trip header 34 is blocked and the trip header 34 is depressurized through the system of dump valves 30. Similarly, the failure of a single solenoid valve 31 (e.g., failure to move to its de-energized and/or closed position) may not adversely impact the tripping function of the TMA 22. In this case, the TMA 22 system of dump valves 30 may operate in the same manner in each of the block-and-bleed (BB) configuration, a remote pilot (RP) configuration, and local pilot (LP) configuration.

Figure 3:
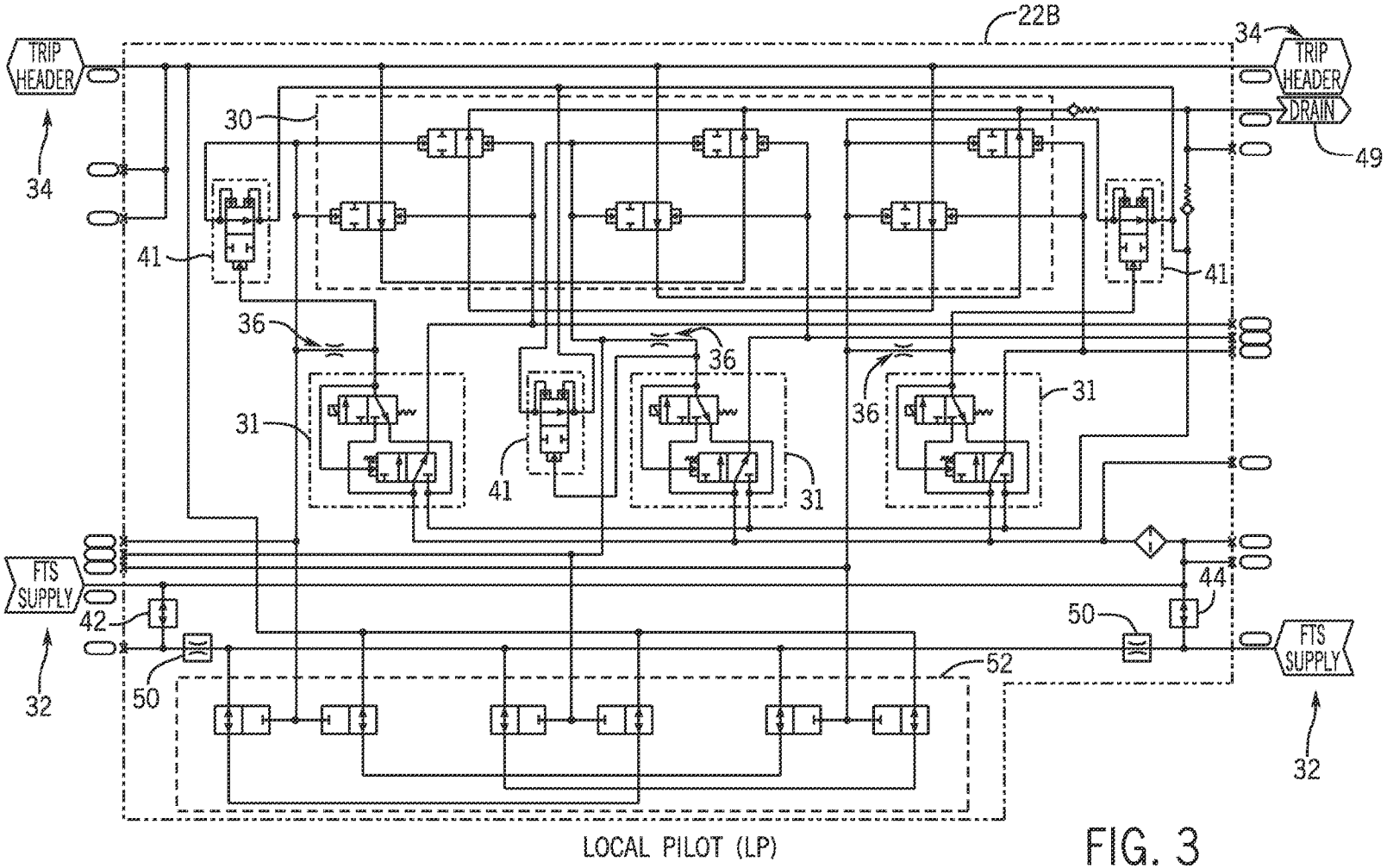
FIG. 3 is a block diagram of an embodiment of the TMA within the system of FIG. 1, including a local pilot (LP) configuration, in accordance with present embodiments.

In certain embodiments, as illustrated in FIG. 3, the TMA 22 may include the local pilot (LP) configuration 22B. The LP configuration 22B of the TMA 22 may include a system of open cavity plugs 52. The LP configuration 22B of the TMA 22 may be used for turbine 12 configurations in which the FTS supply 32 and pilot pressure supply to the trip header 34 are provided through the FTS port 32. However, in the LP configuration 22B of the TMA 22, it may be useful to maintain a steady state leakage flow through the turbine trip header 34 when in the trip (e.g., closed and/or open) position. As depicted, in the present embodiment, FTS supply 32 may be blanked, and any supply valves may be replaced with open flow plugs 42 and 44 and orifices 50 to restrict the leakage flow to the trip headers 34. This may allow the LP configuration 22B of the TMA 22 to be suitable for use with turbine 12 system configurations, in which a leakage flow through the TMA is desired even during a trip event, as opposed to that of the BB configuration 22A of the TMA 22 discussed with respect to FIG. 2.

Figure 4:
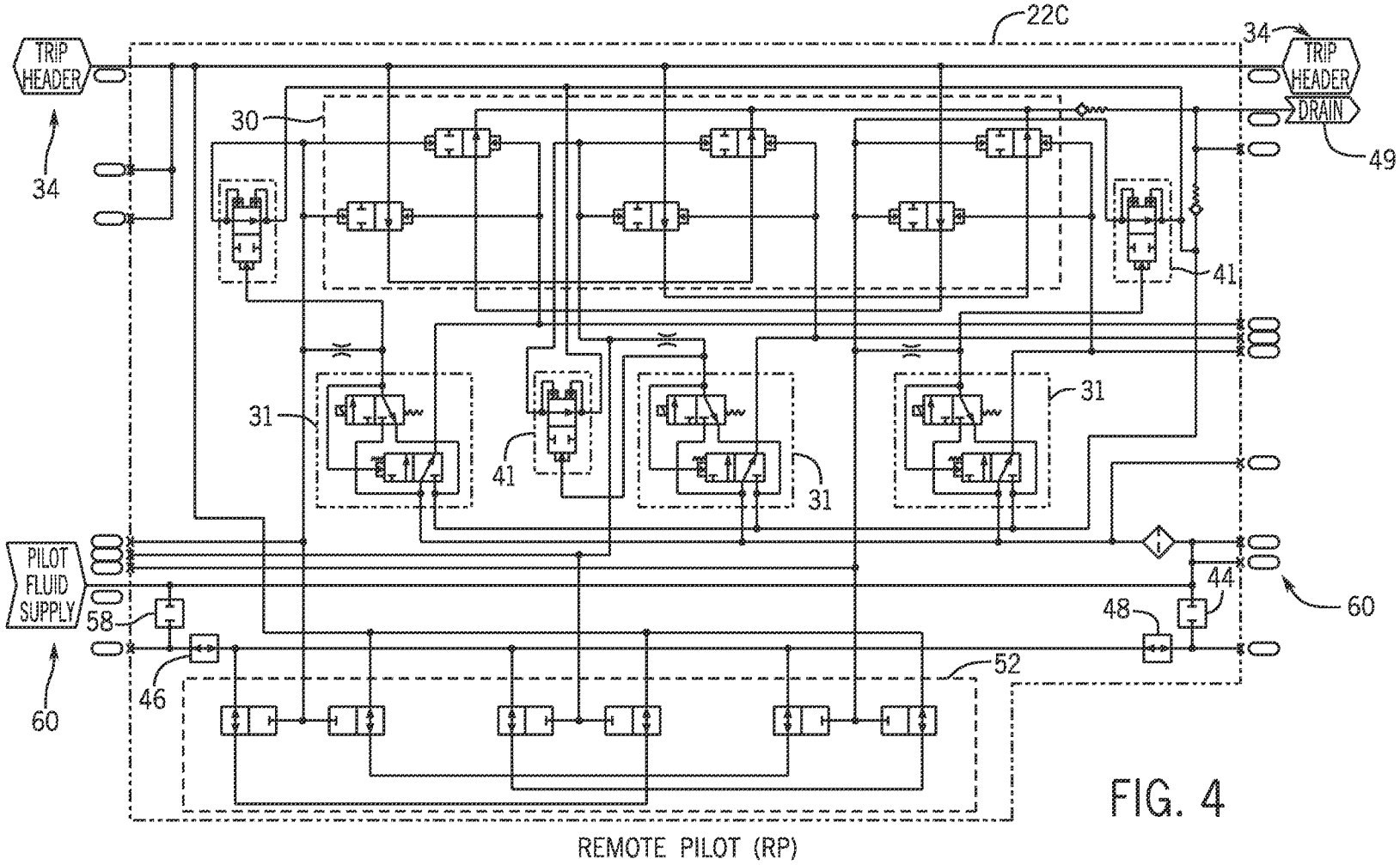
FIG. 4 is a block diagram of an embodiment of the TMA within the system of FIG. 1, including a remote pilot (RP) configuration, in accordance with present embodiments.

Similarly, FIG. 4 illustrates the RP configuration 22C of the TMA 22. The RP configuration 22C of the TMA 22 may also include a system of open cavity plugs 52. As also depicted, the RP configuration 22C of the TMA 22 may include a remote pilot fluid supply 60. Specifically, the RP configuration 22C of the TMA 22 may also include FTS ports that may be blanked. Any block valves may be replaced with open cavity plugs 52 and closed plugs 58 that are blocked to ultimately provide a pilot pressure source to the solenoid valves 31 from the RPS ports. This may allow the RP configuration 22C of the TMA 22 to be used with certain turbine 12 system configurations, in which the pilot pressure is supplied to the solenoid valves 31 substantially independently.

Technical effects of the present embodiments relate to an advanced electro-hydraulic trip manifold assembly (TMA) suitable for use with turbine emergency shutdown systems and/or emergency overspeed protection systems (EOPS). Specifically, the TMA may include an interface between an electronic control system and hydraulically powered final control elements (e.g., stop valves) of the turbine control and emergency shutdown system. In certain embodiments, the TMA may be contamination resistant and fault tolerant, exhibit a triple modular redundant (TMR) design, and may also be configurable to a block-and-bleed (BB) configuration, a remote pilot (RP) configuration, and a local pilot (LP) configuration to allow application to substantially all commercially available (or those that may become available in the future) turbine and EOPS system configurations and/or operating conditions. The TMA may also include parallel arrangements of solenoid valves, block valves, instrumented dump valves, relay valves, orifices, filter, and check valves, packaged as a single integrated hydraulic circuit with defined configurable flow passages. In this way, the TMA may provide for large flow capacity, extremely fast response times (e.g., as compared to non-configurable and/or single-configuration manifolds), and increased tolerance to contamination that may become present in hydraulic flow control systems, and reduced system complexity, and other similar advantages.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a trip manifold assembly (TMA), comprising:

a plurality of block and bleed valves configured to receive a flow of fluid from a hydraulic power unit (HPU), wherein the plurality of block and bleed valves are disposed so as to provide for at least three parallel output flow streams; and a plurality of solenoid valves configured to admit the flow of fluid to actuate the plurality of block and bleed valves, a plurality of dump valves, and a plurality of relay valves of the TMA, wherein each of the plurality of solenoid valves is configured to admit a respective portion of the flow of fluid, wherein the plurality of solenoid valves are arranged in three groups of two solenoid valves per group so that each of the three groups enables a redundant flow control over a different one of the three parallel output flow streams such that when one stream of the three parallel output flow streams depressurizes, at least one other stream of the three parallel output flow streams maintains pressurization, and wherein the plurality of dump valves is configured to depressurize a trip header of the TMA as an output to operate a plurality of stop valves coupled to a turbine system;

wherein the TMA is configured to regulate the flow of fluid to control the operation of the plurality of stop valves as a mechanism to interrupt an operation of the turbine system.

2. The system of claim 1, wherein the two solenoid valves per group are configured to admit the flow of fluid in parallel, to provide for redundant solenoid valve operations.

3. The system of claim 1, wherein the TMA is configured to operate at a pressure of at least one of less than 200 pounds per square inch gauge (psig), less than 100 psig, less than 90 psig, less than 85 psig, less than 80 psig, less than 75 psig, less than 70 psig, less than 65 psig, or less than 60 psig.

4. The system of claim 1, wherein the TMA is configured to operate at a pressure greater than at least one of 800 pounds per square inch gauge (psig), greater than 1000 psig, greater than 2000 psig, greater than 2100 psig, greater than 2200 psig, greater than 2300 psig, or greater than 2400 psig.

5. The system of claim 1, wherein the TMA is configurable to operate in a block and bleed (BB) configuration, in which the plurality of block and bleed valves is configured to block a fluid supply path during the interruption of the operation of the turbine system.

6. The system of claim 1, wherein the TMA is configured to reduce a response time in which the turbine system is interrupted.

7. The system of claim 1, comprising the turbine system, a generator system, or a combination thereof, communicatively coupled to the TMA.

8. The system of claim 7, wherein the the TMA is configured to operate according to a triple modular redundant (TMR) functionality, wherein the TMA is configured to regulate the flow of fluid to control the operation of the turbine system, the generator system, or the combination thereof, via only a first group and a second group of the three groups of the plurality of solenoid valves, or via the first group, the second group, and a third group of the three groups of the plurality of solenoid valves.

9. A system, comprising:

a plurality of stop valves coupled to a turbine system;

a hydraulic power unit (HPU) configured to deliver a flow of fluid to the plurality of stop valves to regulate the turbine system; and a trip manifold assembly (TMA) communicatively coupled to the plurality of stop valves and the HPU, comprising:

a plurality of block and bleed valves configured to receive the flow of fluid from the HPU, wherein the plurality of block and bleed valves are disposed so as to provide for at least three parallel output flow streams;

a plurality of solenoid valves configured to admit the flow of fluid to actuate the plurality of block and bleed valves, a plurality of dump valves, and a plurality of relay valves of the TMA, wherein the plurality of solenoid valves are arranged in three groups of two solenoid valves per group so that each of the three groups enables a flow control over a different one of the three parallel output flow streams such that when one stream of the three parallel output flow streams depressurizes, at least one other stream of the three parallel output flow streams maintains pressurization, and wherein the plurality of relay valves is respectively coupled to each of the plurality of solenoid valves, wherein the plurality of dump valves is respectively coupled to each of the plurality of solenoid valves and each of the plurality of relay valves, and wherein the plurality of dump valves is configured to depressurize a trip header of the TMA as an output to operate the plurality of stop valves to interrupt an operation of the turbine system.

10. The system of claim 9, wherein the plurality of block and bleed valves, the plurality of solenoid valves, the plurality of dump valves, and the plurality of relay valves are configured to increase flow capacity.

11. The system of claim 9, wherein the plurality of block and bleed valves, the plurality of solenoid valves, the plurality of dump valves, and the plurality of relay valves are configured to increase contamination tolerance.

12. The system of claim 9, wherein the plurality of block and bleed valves, the plurality of solenoid valves, the plurality of dump valves, and the plurality of relay valves are configured to reduce a response time in which the turbine system is interrupted.

13. The system of claim 9, comprising a controller communicatively coupled to the TMA, wherein the controller is configured to generate a signal to activate or deactivate the plurality of solenoid valves to interrupt the operation of the turbine system.

14. The system of claim 9, wherein each of the plurality of block and bleed valves, the plurality of solenoid valves, the plurality of dump valves, and the plurality of relay valves comprises a plurality of poppet style valves.

15. The system of claim 9, wherein the TMA is configured to operate within a pressure range between 75 pounds per square inch gauge (psig) to 2700 psig.

* * * * *